US011015455B2

(12) United States Patent
Zhang et al.

(10) Patent No.: US 11,015,455 B2
(45) Date of Patent: May 25, 2021

(54) INTERNALLY COOLED TURBINE BLADE WITH CREEP REDUCING DIVIDER WALL

(71) Applicant: PRATT & WHITNEY CANADA CORP., Longueuil (CA)

(72) Inventors: Chao Zhang, Vaughan (CA); Michael Papple, Verdun (CA); Marc Tardif, Candiac (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 97 days.

(21) Appl. No.: 16/380,288

(22) Filed: Apr. 10, 2019

(65) Prior Publication Data

US 2020/0325781 A1 Oct. 15, 2020

(51) Int. Cl.
*F01D 5/18* (2006.01)

(52) U.S. Cl.
CPC ..... *F01D 5/187* (2013.01); *F05D 2250/185* (2013.01); *F05D 2260/20* (2013.01); *F05D 2260/941* (2013.01)

(58) Field of Classification Search
CPC . F01D 5/18; F01D 5/185; F01D 5/186; F01D 5/187; F01D 5/188; F01D 5/189; F05D 2250/185
See application file for complete search history.

(56) References Cited

U.S. PATENT DOCUMENTS 6,036,440 A * 3/2000 Tomita ..... F01D 5/187 415/114
6,257,830 B1 * 7/2001 Matsuura ..... F01D 5/147 415/115
6,957,949 B2 * 10/2005 Hyde ..... F01D 5/187 416/96 R
6,974,308 B2 12/2005 Halfmann et al.
7,150,601 B2 12/2006 Pietraszkiewicz et al.
8,585,351 B2 * 11/2013 Bregman ..... F01D 5/20 415/115
8,777,568 B2 * 7/2014 Ellis ..... F01D 5/087 416/96 R
9,120,144 B2 * 9/2015 Lee ..... F01D 5/187
9,145,780 B2 * 9/2015 Propheter-Hinckley ..... F01D 5/186
2004/0076519 A1 * 4/2004 Halfmann ..... B22C 9/103 416/97 R
2006/0153678 A1 * 7/2006 Liang ..... F01D 5/187 416/97 R
2014/0086724 A1 * 3/2014 Tibbott ..... F01D 5/186 415/1
2017/0138204 A1 * 5/2017 Jimbo ..... F01D 5/187
(Continued)

FOREIGN PATENT DOCUMENTS

GB 1188401 A * 4/1970 ..... F01D 5/187
WO WO-2008155248 A1 * 12/2008 ..... F01D 5/188

*Primary Examiner* — Eldon T Brockman
*Assistant Examiner* — Topaz L. Elliott
(74) *Attorney, Agent, or Firm* — Norton Rose Fulbright Canada LLP

(57) ABSTRACT

A method of reducing creep in an internally cooled turbine blade, comprising: providing a radially extending intermediate wall to continuously join a localized high stress zone of a concave side wall and a convex side wall in an intermediate cooling air channel through the blade. The intermediate wall distributes stress from the localized zone to a zone of lower stress to balance the creep inducing stress and temperature more evenly.

16 Claims, 4 Drawing Sheets

(56) References Cited

U.S. PATENT DOCUMENTS

| | | | | |
|---|---|---|---|---|
| 2018/0051566 | A1 | 2/2018 | Bunker | |
| 2019/0330986 | A1* | 10/2019 | Anderson | F01D 9/041 |
| 2020/0378263 | A1* | 12/2020 | Xu | F01D 5/186 |

* cited by examiner

INTERNALLY COOLED TURBINE BLADE WITH CREEP REDUCING DIVIDER WALL

TECHNICAL FIELD

The disclosure relates generally to gas turbine engines, and more particularly to an internally cooled turbine blade.

BACKGROUND

Creep is defined as a time-dependent strain or distortion experienced by materials such as metals when exposed to continued stress and high temperatures. The stress may be in the elastic range below the material yield strength and high temperature may be below the melting point but time-dependent creep strain or deformation results from certain parameters.

Gas turbine blades are exposed to centrifugal stress from high turbine rotational speeds, lateral stresses from gas path flow resistance, and high temperature. Creep distortion of turbine blades can stretch the blade length such that the blade tip interferes with the turbine shroud. Creep can also change the airfoil shape reducing aerodynamic efficiency. Creep may lead to crack initiation on the blade, reducing its useful service life.

Improvement is thus desirable.

SUMMARY

In one aspect, the disclosure describes an internally cooled turbine blade comprising an internally cooled turbine blade comprising: an airfoil having a concave side wall and a convex side wall extending spanwise between a platform and a blade tip, and chordwise between a leading edge and a trailing edge, an internal cooling passage within the airfoil extending between a cooling air inlet and a plurality of air outlets, the internal cooling passage including: a serpentine passage having in series a leading edge channel, an intermediate channel and a trailing edge channel, the leading edge channel and the intermediate channel separated by a first dividing wall, the intermediate channel and the trailing edge channel separated by a second dividing wall; and wherein the intermediate channel has an intermediate wall continuously joining the concave and convex side walls, the intermediate wall extending radially between the first and second dividing walls along a central length portion of the intermediate channel for more than half but less than all of the length of the intermediate channel.

In another aspect the disclosure describes a method of reducing creep in an internally cooled turbine blade, comprising: providing a radially extending intermediate wall to continuously join a concave side wall and a convex side wall in an intermediate channel for conveying cooling air through the blade.

Embodiments can include combinations of the above features. Further details of these and other aspects of the subject matter of this application will be apparent from the detailed description included below and the drawings.

DETAILED DESCRIPTION

Figure 1:
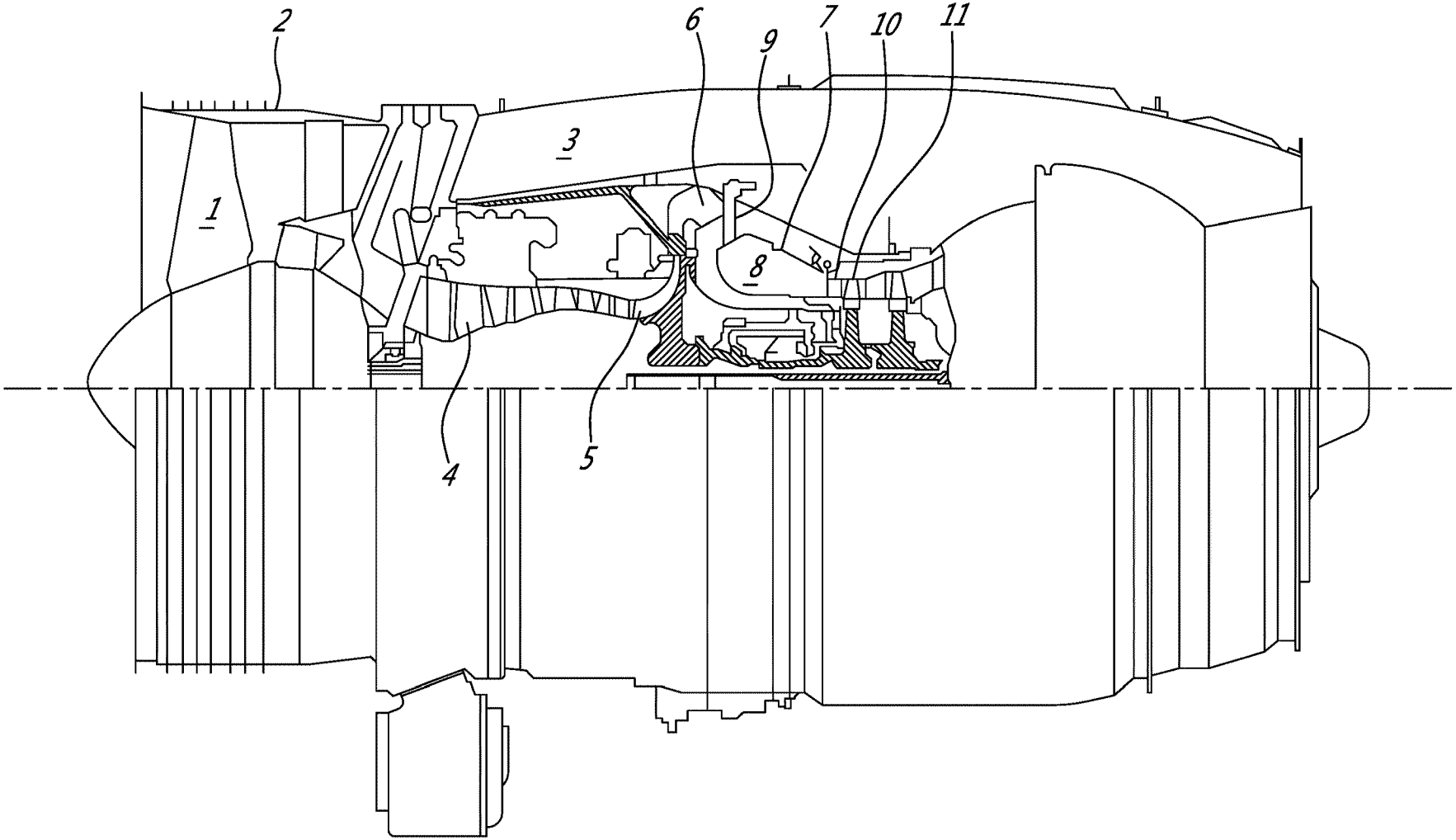
FIG. 1 shows an axial cross-section view of an exemplary turbofan gas turbine engine.

FIG. 1 illustrates a gas turbine engine of a type preferably provided for use in subsonic flight, generally comprising in serial flow communication a compressor section 4, 5 for pressurizing the air, a combustor 8 in which the compressed air is mixed with fuel and ignited for generating an annular stream of hot combustion gases, and a turbine section 11 for extracting energy from the combustion gases.

Compressed air exits the compressor 5 through a diffuser 6 and is contained within a plenum 7 that surrounds the combustor 8. Fuel is supplied to the combustor 8 through fuel tubes 9 and fuel is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbine section 11 before exiting the tail of the engine as exhaust.

Figure 2:
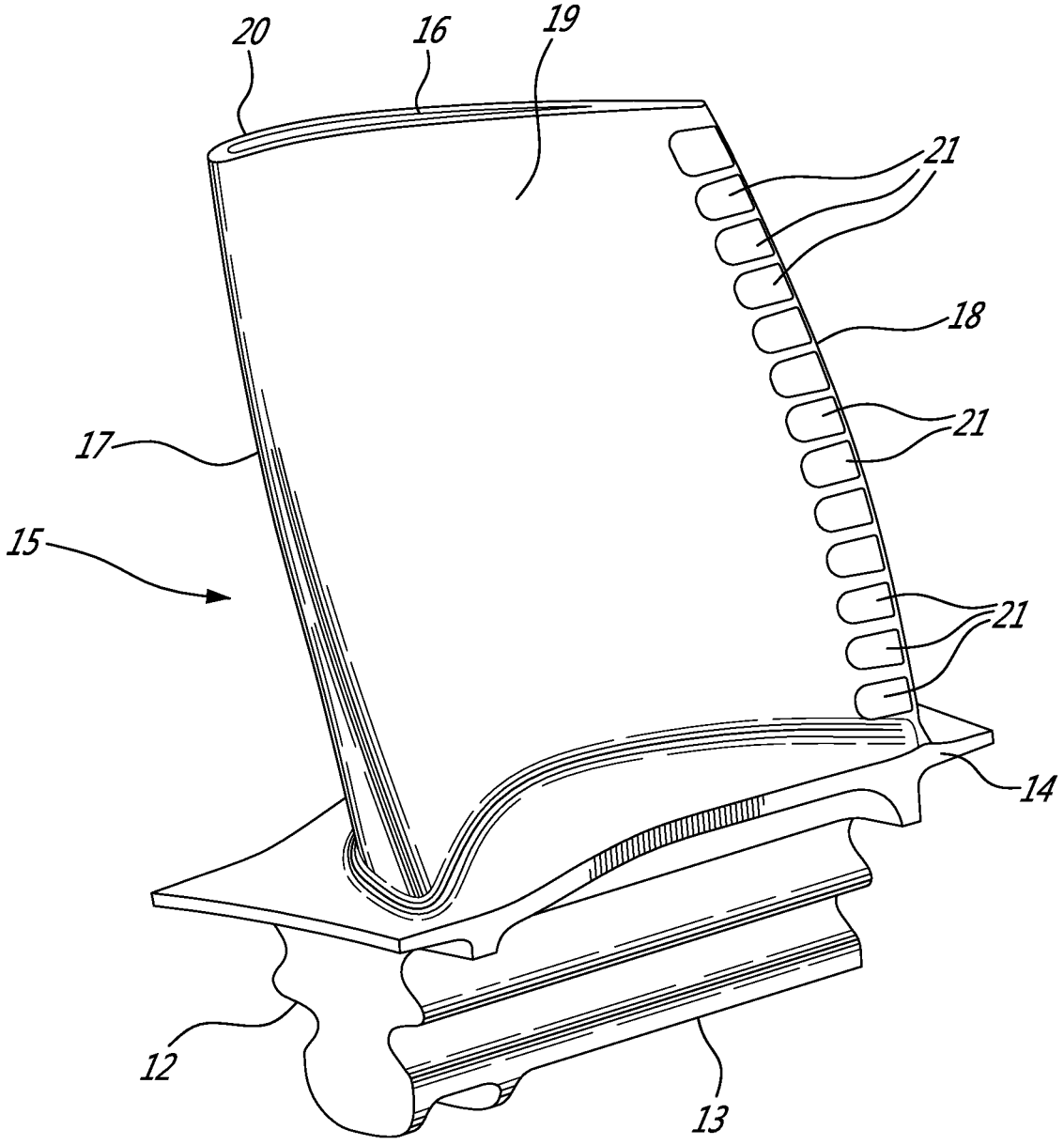
FIG. 2 is an isometric leading edge-concave side view of a turbine blade, with an airfoil, blade root and platform.
Figure 3:
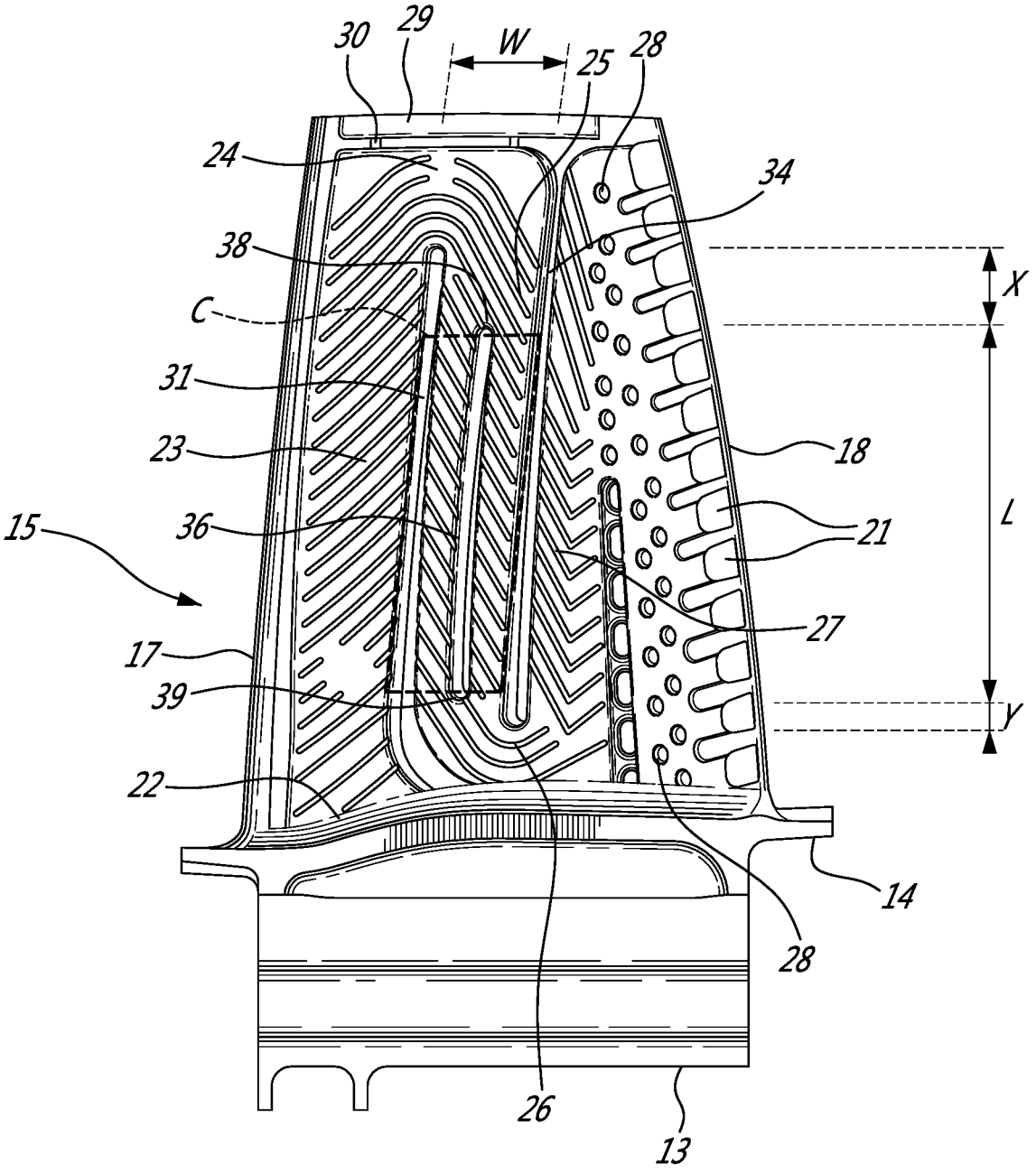
FIG. 3 is a partial radial-axial sectional view through the airfoil of FIG. 2 to show the serpentine internal cooling channels commencing at an inlet from the turbine hub adjacent to the platform at the upstream leading edge and terminating downstream at the trailing edge exhausting through air outlets.

With reference to FIGS. 2 and 3, the present description and drawings relate to the turbine blades 12 of the turbine section 11. Each blade 12 has a blade root 13 that is mounted in mating sockets to the turbine hub of a turbine rotor. The turbine hub is supplied with compressed cooling air from the compressors 4, 5 that is then directed into the serpentine cooling channels of each blade 12 (see FIGS. 3-4 and description below). FIG. 2 shows the external elements of the blade 12 that include a platform 14 between the root 13 and an airfoil 15. The airfoil has a radially outward blade tip 16, an upstream leading edge 17, a downstream trailing edge 18, a concave or pressure side wall 19, and (on an opposite side) a convex or suction side wall 20. The trailing edge 18 has a spaced-apart series of cooling air outlets 21 that exhaust the cooling air from the internal cooling passages into the gas flow passing downstream over the airfoil 15.

Figure 4:
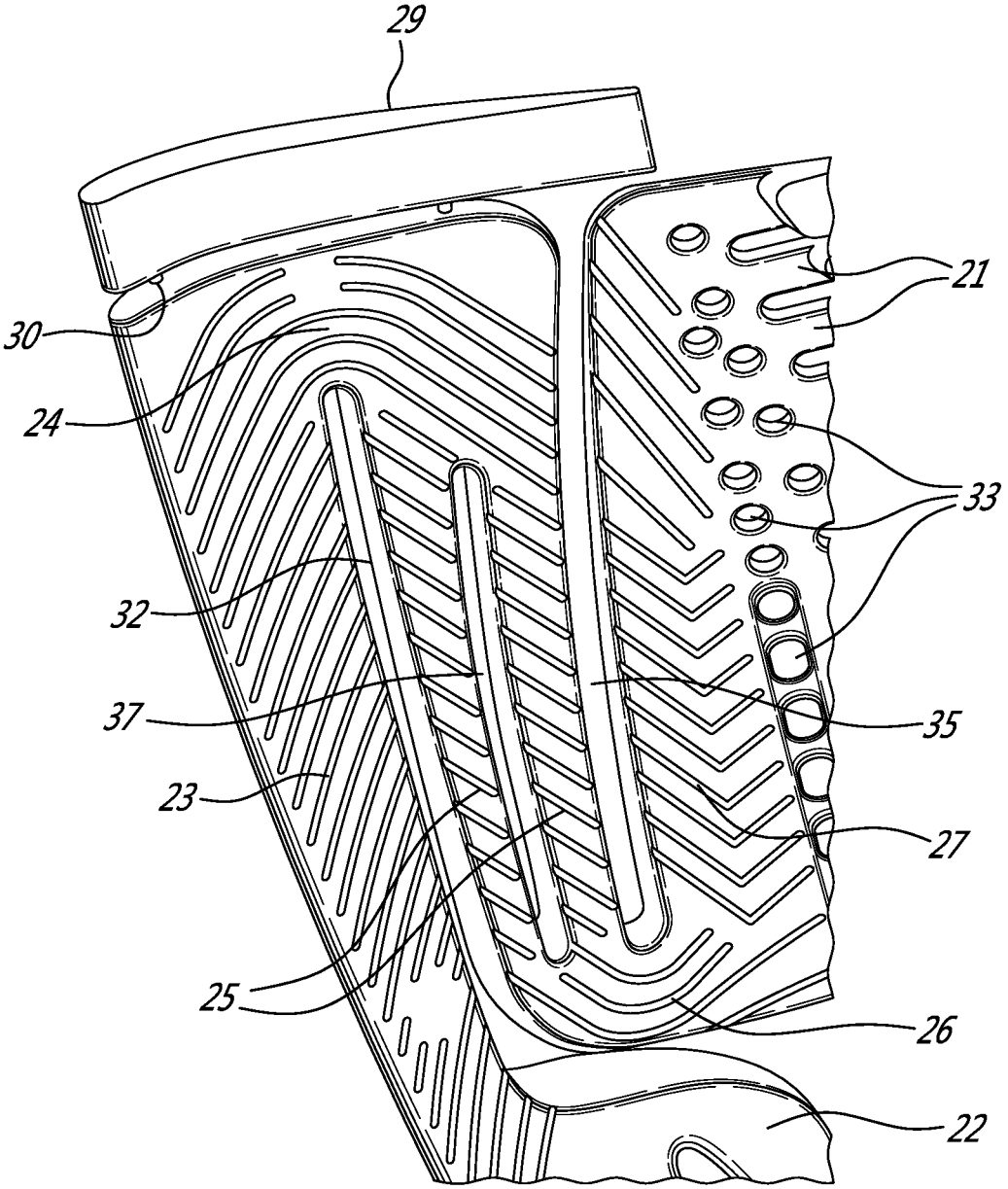
FIG. 4 is a schematic 3D view of a core for forming the hollow serpentine internal cooling channels with the blade metal not visible to conceptualize the air flow channels and dividing walls as a conduit.

FIGS. 3 and 4 show the details of the internal cooling channels as follows. The internally cooled turbine blade 12 has a blade root 13 having a cooling air inlet 22 adapted for communication with the turbine hub (not shown) which has a supply conduit to a source of pressurized air. The airfoil 15 has a serpentine internal cooling passage communicating between the cooling air inlet 22 and a plurality of air outlets 21 in the trailing edge 18.

From upstream to downstream, the internal cooling passage begins at the air inlet 22 directing cooling air in a radially outward direction into the leading edge channel 23. A first reverse bend 24 directs the air flow in a radially inward direction into an intermediate channel 25. A second reverse bend 26 directs the air flow in a radially outward direction from the intermediate channel 25 into a trailing channel 27. The air flow passes from the trailing channel 27 and past a series of posts 28 that join the concave side wall 19 and the convex side wall 20 and exhausting from the airfoil 15 through the air outlets 21.

To complete the explanation of the drawings, the blade tip 16 has a blade tip recess 29 that is also supplied with compressed air from the first reverse bend 24 through two ports 30. However the present description is directed to the serpentine internal passage (22, 23, 24, 25, 26, 27, 21) and the internal dividing walls that define it.

The leading edge channel 23 is defined between the leading edge 17 and a first dividing wall 31. The first dividing wall 31 extends radially outwardly from the blade root 13 to the first reverse bend 24 and mechanically joins the concave side wall 19 and the convex side wall 20 of the airfoil 15. FIG. 4 shows a reverse solid view. In FIG. 4 the hollow serpentine internal passage is shown as a 3D solid whereas the solid metal of the airfoil (ex: concave side wall 19 and the convex side wall 20) is not shown for clarity. In the case of the first dividing wall 31, FIG. 4 shows the configuration of the wall 31 as an elongate void 32, and shows the configuration of the posts 28 in reverse as openings 33.

The intermediate channel 25 is defined between the first dividing wall 31 and a second dividing wall 34. FIG. 4 shows the configuration of the second dividing wall 34 as a radially elongated void 35. The second dividing wall 34 extends radially inwardly from the blade tip 16 to the second reverse bend 26. The second dividing wall 34 joins the concave side wall 19 and the convex side wall 20 together. The trailing channel 27 is defined between the second dividing wall 34 and the plurality of air outlets 21. The trailing channel 27 includes means to direct and divide the cooling air flow with the various shaped posts 28 that also joins the concave side wall 19 and the convex side wall 20 to define the array of air outlets 21.

To reduce air flow friction losses, the internal surfaces of the channels 23, 25, 27 are rounded. The leading edge channel 23 and intermediate channel 25 merge arcuately with the first reverse bend 24. The intermediate channel 25 and trailing channel 27 merge arcuately with the second reverse bend 26.

The intermediate channel 25 includes an intermediate dividing wall 36 extending radially parallel to the first and second dividing walls 31, 34. FIG. 4 shows the configuration of the intermediate dividing wall 36 as an elongate void 37 The intermediate dividing wall 36 has an outer end 38 radially inward from the first reverse bend 24 and an inward end 39 radially outward from the second reverse bend 26. The intermediate dividing wall 36 joins the concave side wall 19 and the convex side wall 20 continuously between the outward and inward ends 38, 39.

The localized portions of the concave side wall 19 and the convex side wall 20 that are adjacent to and define the intermediate channel 25 may be susceptible to localized material creep deformation as a result of high stress and high temperature over extended time periods of operation in this particular area. The inventors have provided a method of reducing creep in the internally cooled turbine blade 12 using the radially extending intermediate wall 36 to continuously join the concave side wall and the convex side wall in the intermediate channel 25. The intermediate wall 36 provides a local structural reinforcement that reduces stress in the adjacent local area by distributing stress from a highly stressed area to areas of lower stress. As a result the creep risk is lowered because the stress level is lowered in a susceptible local area.

FIGS. 3 and 4 show an example configuration with a single intermediate dividing wall 36 in a relatively long airfoil. However, it will be understood that various alternative configurations may include short stocky airfoils with air flow channels of different sizes and shapes. Where a high level of stress is indicated by finite element analysis, various intermediate dividing walls 36 may be used to alleviate local high stress zones.

Referring to FIG. 3, the example configuration illustrated shows that the intermediate channel 25 has a width dimension "W" in a chord-wise direction. The intermediate wall 36 is shown disposed in a central area of the width of the intermediate channel 25 spaced equidistantly from the first and second dividing walls 31, 34. Depending on the cooling air flow and location of maximum stress in the adjacent concave and convex walls 19, 20 of the airfoil 15, the intermediate dividing wall 36 may be positioned asymmetrically within the intermediate channel 25.

In the example shown, the intermediate wall 36 has a width in a chord-wise direction that is no greater than a minimum width of the first dividing wall 31 and/or the second dividing wall 34. The inclusion of the intermediate dividing wall 36 may enable the reduction of the other dividing walls 31, 34 and hence a variation in weight distribution in the airfoil 15.

Accordingly a creep reinforced zone "C" (dashed lines in FIG. 3) is defined in the concave side wall 19 and in the convex side wall 20 adjacent to the intermediate channel 25. The creep reinforced zone "C" spans the width "W" of the intermediate channel 25 and the length "L" of the intermediate wall 36. The length "L" is defined between the inner end 39 and outer end 38 of the intermediate wall 36. The width relative to the length of the creep reinforced zone "C" can be defined as an aspect ratio no greater than 1:1 (i.e.: a square). However the drawings show an aspect ratio in the range of 1:6 to 1:3, and preferably 1:4.

As indicated in FIG. 3, the inner end 39 of the intermediate wall 36 is disposed radially outward from an apex of the trailing dividing wall by an inner dimension "Y". The outer end 38 of the intermediate wall 36 is disposed radially inward from an apex of the leading dividing wall 31 by an outer dimension "X". In the example illustrated, a ratio of the inner dimension "Y":intermediate wall length "L":outer dimension "X" is in the range of 1-3: 10-14:0-2, and particularly a ratio in the range of 2:12:1. It can be appreciated that the intermediate wall 36 extends longitudinally along a major portion of the length of the intermediate channel 25.

The local divider wall 36 joins the blade concave and convex airfoil walls 19, 20. This local divider wall 36 redistributes loads within the blade material, to reduce local creep strain/stress and improve blade durability. The local divider wall 36 overall length L, thickness and position within the airfoil 15 are also optimized to reduce its adverse effects on the internal cooling flow. By using the local divider wall 36, other design features such as thicker convex and concave airfoil walls 19, 20 are not required to reduce creep strain/stress. This minimizes the blade weight increase and centrifugally-induced loads within the blade and its supporting hub. The strength of these components does not require to be increased and further benefits can then be obtained in terms of total engine weight, performance and operating cost.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. An internally cooled turbine blade of a rotor having an axis of rotation, the internally cooled turbine blade comprising:

an airfoil having a concave side wall and a convex side wall extending spanwise between a platform and a blade tip, and chordwise between a leading edge and a trailing edge, an internal cooling passage within the airfoil extending between a cooling air inlet and a plurality of air outlets, the internal cooling passage including:

a serpentine passage having in series a leading edge channel, an intermediate channel and a trailing edge channel, the leading edge channel and the intermediate channel separated by a first dividing wall, the intermediate channel and the trailing edge channel separated by a second dividing wall; and wherein the intermediate channel has an intermediate wall continuously joining the concave and convex side walls, the intermediate wall extending along a spanwise direction between the first and second dividing walls and along a central length portion of the intermediate channel for more than half but less than all of a length of the intermediate channel, wherein a radially outer end of the intermediate wall is disposed radially inward from an apex of the first dividing wall in a radial direction relative to the axis of rotation of the rotor.

2. The internally cooled turbine blade according to claim 1 wherein the intermediate channel has a width in a chordwise direction, and wherein the intermediate wall is spaced-apart from the first dividing wall and the second dividing wall in the chord-wise direction.

3. The internally cooled turbine blade according to claim 2 wherein the intermediate wall is disposed equidistantly from the first and second dividing walls.

4. The internally cooled turbine blade according to claim 2 wherein the intermediate wall has a width in the chordwise direction that is no greater than a minimum width of the first dividing wall.

5. The internally cooled turbine blade according to claim 4 wherein the width of the intermediate wall is no greater than a minimum width of the second dividing wall.

6. The internally cooled turbine blade according to claim 2 wherein a creep reinforced zone is defined in the concave side wall and in the convex side wall adjacent to the intermediate channel, the creep reinforced zone spanning the width of the intermediate channel and a length of the intermediate wall, the width relative to the length of the creep reinforced zone defining an aspect ratio no greater than 1:1.

7. The internally cooled turbine blade according to claim 6 wherein the aspect ratio is in the range of 1:6 to 1:3.

8. The internally cooled turbine blade according to claim 7 wherein the aspect ratio is 1:4.

9. The internally cooled turbine blade according to claim 6 wherein a radially inner end of the intermediate wall is disposed radially outward from an apex of the second dividing wall by an inner dimension Y in a radially outward direction relative to the axis of rotation of the rotor.

10. The internally cooled turbine blade according to claim 9 having a ratio of inner dimension Y:intermediate wall length L:outer dimension X in the range of 1-3:10-14: 1-2, wherein X is a spanwise distance from the apex of the first dividing wall to the radially outer end of the intermediate wall, positive values of X defining the intermediate wall inward of the apex of the first dividing wall.

11. The internally cooled turbine blade according to claim 10 wherein the ratio is 2:12:1.

12. A gas turbine engine comprising a turbine rotor and a plurality of internally cooled turbine blades mounted to the turbine rotor, wherein each turbine blade comprises:

a platform;

an airfoil extending radially from the platform, the airfoil having a concave side wall and a convex side wall extending spanwise from the platform to a blade tip, and chordwise from a leading edge to a trailing edge, the airfoil having:

an internal cooling passage communicating between a cooling air inlet and a plurality of air outlets in the trailing edge, the internal cooling passage including:

a leading edge channel defined between the leading edge and a first dividing wall extending radially outwardly from the platform to a first reverse bend, the first dividing wall joining the concave side wall and the convex side wall;

an intermediate channel defined between the first dividing wall and a second dividing wall extending radially inwardly from the blade tip to a second reverse bend, the second dividing wall joining the concave side wall and the convex side wall;

a trailing edge channel defined between the second dividing wall and the plurality of air outlets, and wherein the intermediate channel has an intermediate dividing wall extending along a spanwise direction between the first and second dividing walls, the intermediate dividing wall having an outer end radially inward from the first reverse bend and an inner end radially outward from the second reverse bend, the intermediate dividing wall joining the concave side wall and the convex side wall continuously between the inner and outer ends and extending along a major portion of a length of the intermediate channel, wherein the radially outer end of the intermediate dividing wall is disposed radially inward from an apex of the first dividing wall in a radial direction relative to the axis of rotation of the rotor.

13. A method of reducing creep in an internally cooled turbine blade of a rotor having an axis of rotation, the method comprising:

providing a spanwise extending intermediate wall to continuously join a concave side wall and a convex side wall along a major portion of an intermediate channel configured to convey cooling air through the internally cooled turbine blade, wherein providing includes: disposing the spanwise extending intermediate wall between a first dividing wall and a second dividing wall, the first dividing wall defining a leading edge channel conducting cooling air from an inlet to the intermediate channel, the second dividing wall defining a trailing channel conducting cooling air from the intermediate channel to a plurality of air outlets defined in trailing edge of the internally cooled turbine blade, and wherein a radially outer end of the spanwise extending intermediate wall is disposed radially inward from an apex of the first dividing wall in a radial direction relative to the axis of rotation of the rotor.

14. The method of claim 13, comprising disposing the spanwise extending intermediate wall centrally into the intermediate channel.

15. The method of claim 13, comprising sizing the spanwise extending intermediate wall so that a width thereof in a chord-wise direction is no greater than a minimum width of the first dividing wall.

16. The method of claim 13, wherein an inner end of the spanwise extending intermediate wall is disposed radially outward from an apex of the second dividing wall by an inner dimension Y relative to the axis of rotation, wherein the outer end of the intermediate wall is disposed radially inward from the apex of the first dividing wall by an outer dimension X relative to the axis of rotation, and wherein a ratio of inner dimension Y:intermediate wall length L:outer dimension X is in a range of 1-3:10-14:1-2.

* * * * *